US011187500B1

(12) United States Patent
Albrecht

(10) Patent No.: US 11,187,500 B1
(45) Date of Patent: Nov. 30, 2021

(54) FIRING TRAINS

(71) Applicant: The United States of America, as represented by the Secretary of the Navy, Arlington, VA (US)

(72) Inventor: Nicholas H. Albrecht, Ridgecrest, CA (US)

(73) Assignee: The United States of America, as represented by Secretary of the Navy, Washington, DC (US)

( * ) Notice: Subject to any disclaimer, the term of this patent is extended or adjusted under 35 U.S.C. 154(b) by 0 days.

(21) Appl. No.: 17/109,632

(22) Filed: Dec. 2, 2020

(51) Int. Cl.
*F42B 3/12* (2006.01)
*F42B 5/38* (2006.01)

(52) U.S. Cl.
CPC ..... *F42B 3/124* (2013.01); *F42B 5/38* (2013.01)

(58) Field of Classification Search
CPC ..... F42B 3/124; F42B 5/38
USPC ..... 102/222
See application file for complete search history.

(56) References Cited

U.S. PATENT DOCUMENTS 3,528,372 A * 9/1970 Gardner ..... F42B 3/113 102/201
4,421,030 A * 12/1983 DeKoker ..... F42C 11/00 102/204
4,616,566 A * 10/1986 Yates, Jr. ..... F42B 1/04 102/275.4
7,322,294 B1 * 1/2008 Laib ..... F42C 15/184 102/254
2014/0338910 A1 * 11/2014 Bell ..... E21B 33/124 166/297

FOREIGN PATENT DOCUMENTS

WO WO-2011160099 A1 * 12/2011 ..... F42B 3/121

* cited by examiner

*Primary Examiner* — Samir Abdosh
(74) *Attorney, Agent, or Firm* — Naval Air Warfare Center Weapons Division; James M. Saunders

(57) ABSTRACT

The embodiments are directed to firing trains. The disclosed firing trains include an insensitive acceptor pellet having a proximal end, a distal end, and a plurality of relative percent theoretical maximum density (TMD) zones from the proximal end to the distal end. A donor pellet is adjacent to the insensitive acceptor pellet and is configured to initiate the insensitive acceptor pellet.

19 Claims, 7 Drawing Sheets

FIRING TRAINS

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD

Embodiments generally relate to boosters and firing trains.

Figure 1:
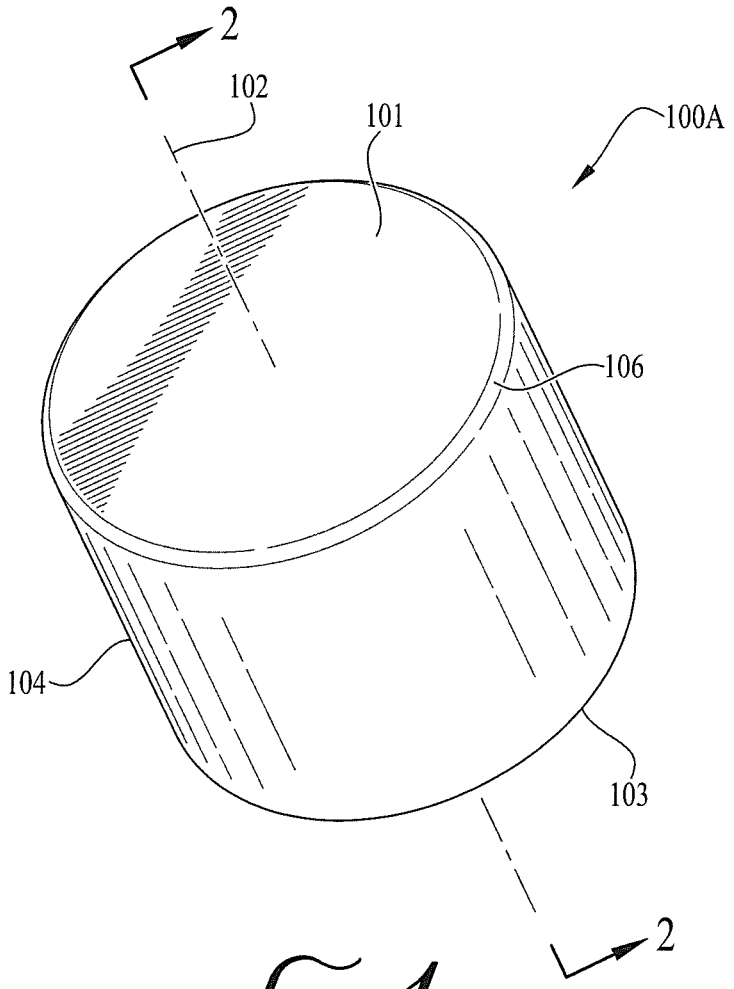
FIG. 1 is an isometric view of a density gradient booster pellet, and more specifically, an insensitive cylindrically-shaped explosive pellet, according to some embodiments.

It is to be understood that the foregoing general description and the following detailed description are exemplary and explanatory only and are not to be viewed as being restrictive, as claimed. Further advantages will be apparent after a review of the following detailed description of the disclosed embodiments, which are illustrated schematically in the accompanying drawings and in the appended claims.

DETAILED DESCRIPTION OF THE EMBODIMENTS

Embodiments may be understood more readily by reference in the following detailed description taking in connection with the accompanying figures and examples. It is understood that embodiments are not limited to the specific devices, methods, conditions or parameters described and/or shown herein, and that the terminology used herein is for the purpose of describing particular embodiments by way of example only and is not intended to be limiting of the claimed embodiments.

Explosives are becoming more insensitive to meet safety requirements for energetic components. The tradeoff, however, is that meeting detonation reliability requirements is becoming more difficult. Currently, as high explosives become more prevalent, to meet explosive firing train reliability requirements, the preceding explosive pellet needs to either be significantly larger or be formulated from a higher performance explosive. These requirements severely complicate fuzing constructions. The disclosed embodiments solve these problems by introducing an explosive pellet having a density gradient region.

High explosive fuzing trains require a balance of size with explosive performance and sensitivity. Insensitive explosives require large shock impulses for reliability. In the explosives field, a primary factor affecting shock sensitivity is density. Shock sensitivity is inversely proportional to density. The embodiments provide an increase in the shock sensitivity for existing insensitive explosive components, allowing for more reliable detonation in insensitive munition's firing trains, by constructing and controlling density as a gradient throughout the explosive pellet. This allows an appropriate shock impulse, i.e. a shock impulse that is both lower in amplitude and duration, to be delivered to the explosive, thus increasing explosive reliability. The disclosed embodiments provide a significant improvement in fuzing reliability without compromising safety.

Although the embodiments are described in considerable detail, including references to certain versions thereof, other versions are possible. Examples of other versions include varying component orientation or hosting embodiments on different platforms. Therefore, the spirit and scope of the appended claims should not be limited to the description of versions included herein.

Apparatus, System, and Method Embodiments—FIGS. 1 through 7

In the accompanying drawings, like reference numbers indicate like elements. For all embodiments and figures, it is understood that the figures are not to scale and are depicted for ease of viewing. FIGS. 1 through 6 and reference characters 100A, 100B, 200, 300, 400, 500, and 600 depict various embodiments, sometimes referred to as apparatus, devices, mechanisms, systems, and similar technology. The reference characters and associated figures are equally applicable to method embodiments. Additionally, FIG. 7 and reference character 700 graphically illustrate a representation of the underlying theory of the embodiments.

Several views are presented to depict some, though not all, of the possible orientations of the embodiments. Some figures depict section views. Section hatching patterning is for illustrative purposes only to aid in viewing and should not be construed as being limiting or directed to a particular material or materials. Components used in several embodiments, along with their respective reference characters, are depicted in the drawings. Components are dimensioned to be close-fitting and to maintain structural integrity both during storage and while in use.

FIG. 1 depicts an isometric view of an embodiment showing a density gradient booster pellet, depicted as 100A in FIG. 1. In firing train embodiments (FIGS. 3 through 6), the density gradient booster pellet is depicted by reference character 100B. In all embodiments, the density gradient booster pellet 100A/100B is an explosive element and can also referred to as an explosive mass or explosive charge. In the embodiments, a single density gradient booster pellet 100A/B is used, which eliminates multiple explosive components in series and the complications of assembly and multiple interfaces, as well as tolerance stack-up. Additionally, the use of a single density gradient booster pellet 100A/B eliminates the need for an individual pellet housing, which also reduces tolerance stack-up.

Figure 2:
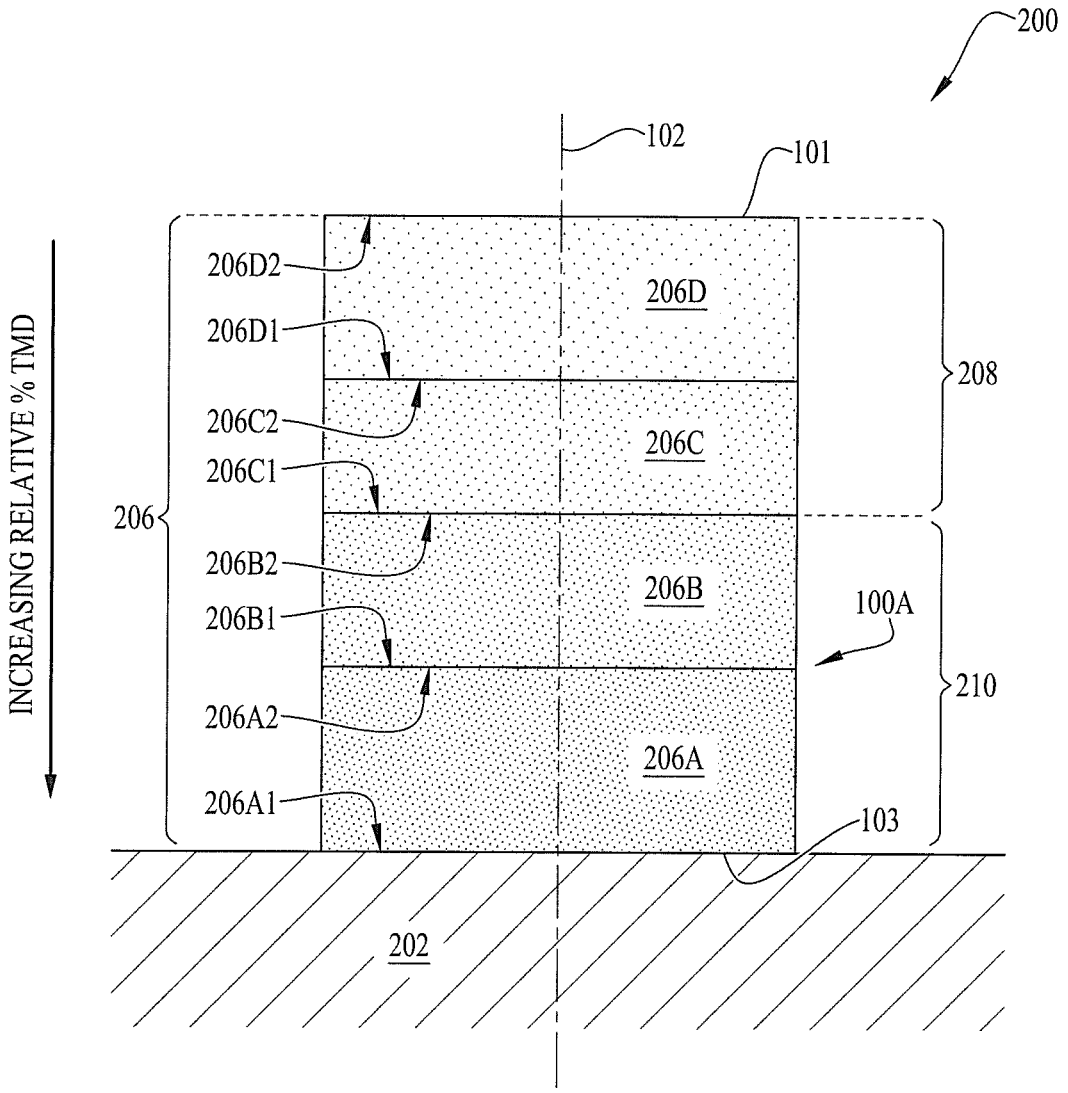
FIG. 2 is a section view of the insensitive cylindrically-shaped explosive pellet perpendicular to the cut plane 2-2 of FIG. 1, illustrating how the pellet relates to one environment.

In FIGS. 1 and 2, the density gradient booster pellet 100A is referred to as an insensitive cylindrically-shaped explosive pellet because it does not receive an external stimulus from another component or initiator. Neither FIG. 1 nor 2 depict firing trains. However, FIGS. 3 through 6 depict firing train embodiments. In the firing train embodiments of FIGS.

3 through 6, reference character 100B depicts the density gradient booster pellet, which is referred to as an insensitive cylindrically-shaped acceptor explosive pellet in the firing train embodiments because it accepts a stimulus from one component or initiator before providing a stimulus to another component.

Referring to FIGS. 1 and 2, the insensitive cylindrically-shaped explosive pellet 100A has a proximal end 101, a distal end 103, and a central longitudinal axis 102 spanning from the proximal end to the distal end. The proximal and distal ends 101 and 103 may also be referred to as the first and second ends or as the input and output ends, respectively. Both the proximal 101 and distal 103 ends have substantially-flat surfaces. The central longitudinal axis 102 can also be referred to in some embodiments as a common longitudinal axis because it is common to many, if not all, depicted components. The insensitive cylindrically-shaped explosive pellet 100A has an outer surface 104 and a beveled interface 106 transitioning the outer surface 104 to the proximal end 101. The beveled interface 106 can also be referred to as a beveled surface, beveled interface surface, and similar variations. Although not depicted in the figures for ease of viewing, a similar interface can also be used to transition the outer surface 104 to the distal end. The beveled interface 106 can help with adhesion and in resisting pellet crumbling.

The FIG. 2 section view illustrates how the insensitive cylindrically-shaped explosive pellet 100A relates to one environment, shown as reference character 200. The view is depicted in section view perpendicular to the cut plane 2-2 of FIG. 1. The distal end 103 of the insensitive cylindrically-shaped explosive pellet 100A is in intimate adjacent contact with an insensitive explosive fill 202. The insensitive explosive fill 202 is a solid mass and can also be referred to as an insensitive explosive billet, main fill, explosive main fill, and similar terminology.

From the proximal end 101 to the distal end 103, as density increases, the output of the insensitive cylindrically-shaped explosive pellet 100A also increases. However, the sensitivity decreases from the proximal end 101 to the distal end 103, i.e. the insensitivity increases from the proximal end to the distal end. Thus, insensitivity and output of the insensitive cylindrically-shaped explosive pellet 100A increase as the insensitive cylindrically-shaped explosive pellet transitions from a minimum relative percent theoretical maximum density at the proximal end 101 to a maximum relative percent theoretical maximum density at the distal end 103.

Figure 3:
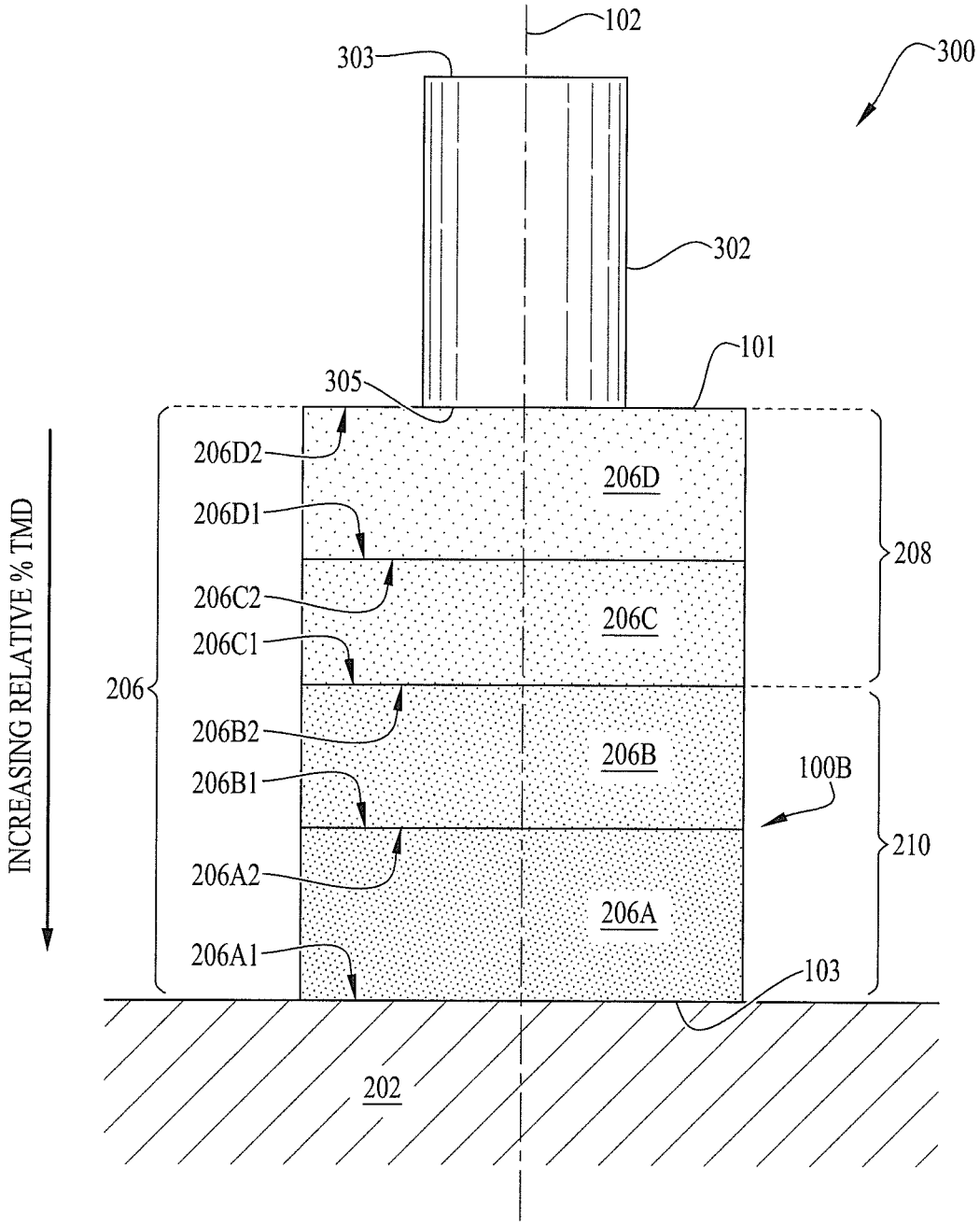
FIG. 3 illustrates a section view of an insensitive cylindrically-shaped acceptor explosive pellet in a firing train, according to some embodiments.

FIG. 3 illustrates a firing train embodiment and is depicted with reference character 300. As mentioned earlier, the density gradient booster is an insensitive cylindrically-shaped acceptor explosive pellet and depicted with reference character 100B in the firing train embodiment 300 because it accepts a stimulus from one component 302 (discussed below) before providing a stimulus to another component (the insensitive explosive fill 202). The FIG. 3 firing train embodiment builds on what was presented in the FIGS. 1 and 2 embodiments.

In FIG. 3, the distal end 103 of the insensitive cylindrically-shaped acceptor explosive pellet 100B is in intimate adjacent contact with the insensitive explosive fill 202. FIG. 3 introduces a donor explosive pellet 302 having a first end 303 and a second end 305. The first end 303 can also be referred to as the donor explosive pellet's input end. Similarly, the second end 305 can also be referred to as the donor explosive pellet's output end 305. The donor explosive pellet 302 is in intimate adjacent contact with the proximal end 101 of the insensitive cylindrically-shaped acceptor explosive pellet 100B. As shown in FIG. 3, the donor explosive pellet 302 is centered on the proximal end 101 of the insensitive cylindrically-shaped acceptor explosive pellet 100B.

The donor explosive pellet 302 is an initiated explosive that, in general, can be initiated mechanically, thermally, electrically, chemically, or by shock. The donor explosive pellet 302 has its own donor explosive pellet central longitudinal axis that is distinct from the central longitudinal axis 102 of the insensitive cylindrically-shaped acceptor explosive pellet 100B. However, in the embodiment illustrated in FIG. 3, both the donor explosive pellet central longitudinal axis and the central longitudinal axis 102 of the insensitive cylindrically-shaped acceptor explosive pellet 100B are aligned with each other and lie along the same axis and, as such, only reference character 102 is used.

Figure 4:
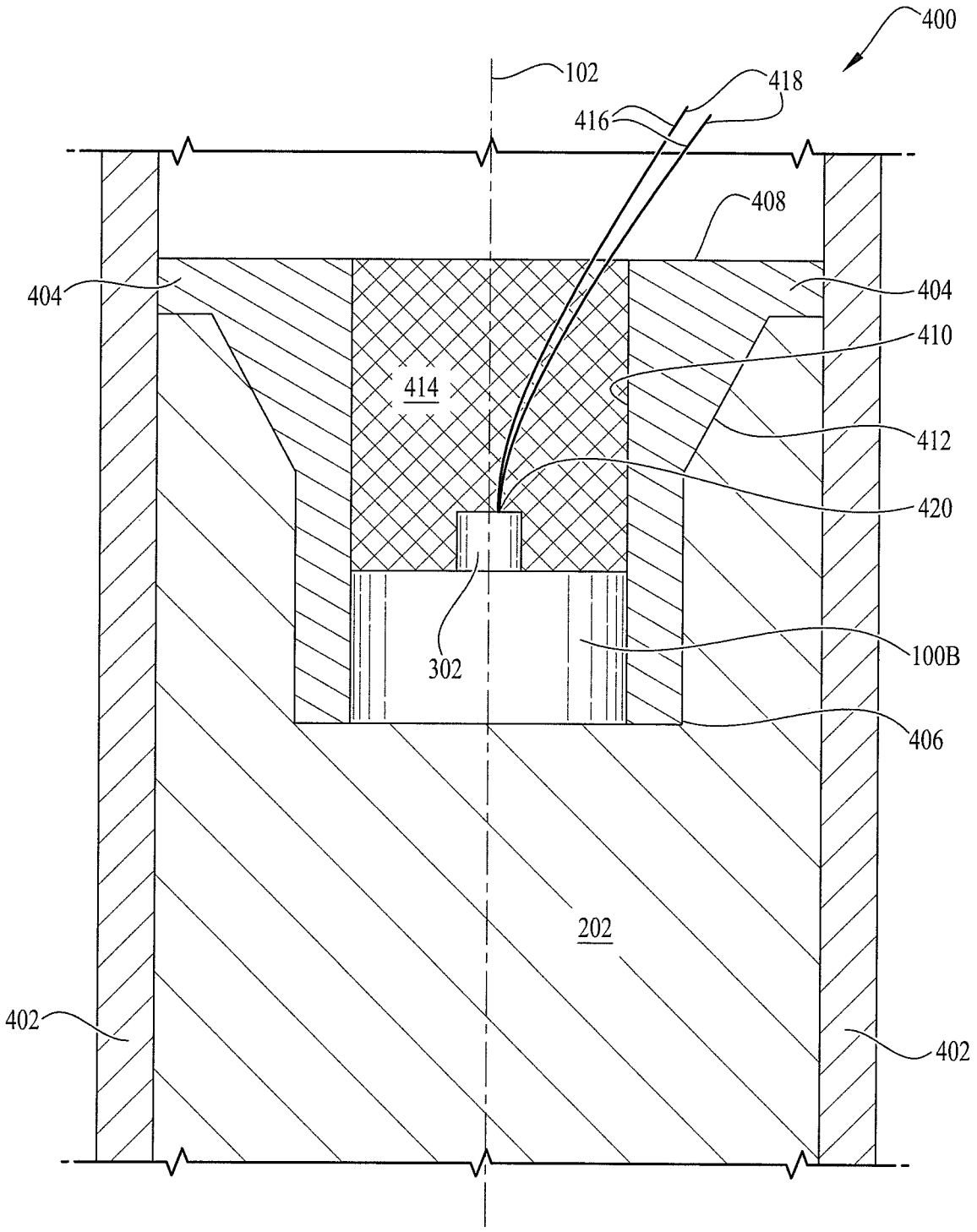
FIG. 4 illustrates a variation of how the insensitive cylindrically-shaped acceptor explosive pellet relates to an operating environment in the aft end of a generic munition.

FIG. 4 illustrates another variation of how the insensitive cylindrically-shaped acceptor explosive pellet 100B relates to an operating environment, depicted as reference character 400. The operating environment 400 is a section view of a firing train in the aft end of a generic munition. Only the aft end of the munition is depicted for ease of viewing. The FIG. 4 operating environment 400 is a separate embodiment that builds on what was presented in the FIG. 3 embodiment. As briefly mentioned earlier, the density gradient booster pellet is referred to as an insensitive cylindrically-shaped acceptor explosive pellet 100B in the firing train embodiment depicted because it accepts a stimulus from one component (the donor explosive pellet 302) before providing a stimulus to another component (the insensitive explosive fill 202).

Figure 5:
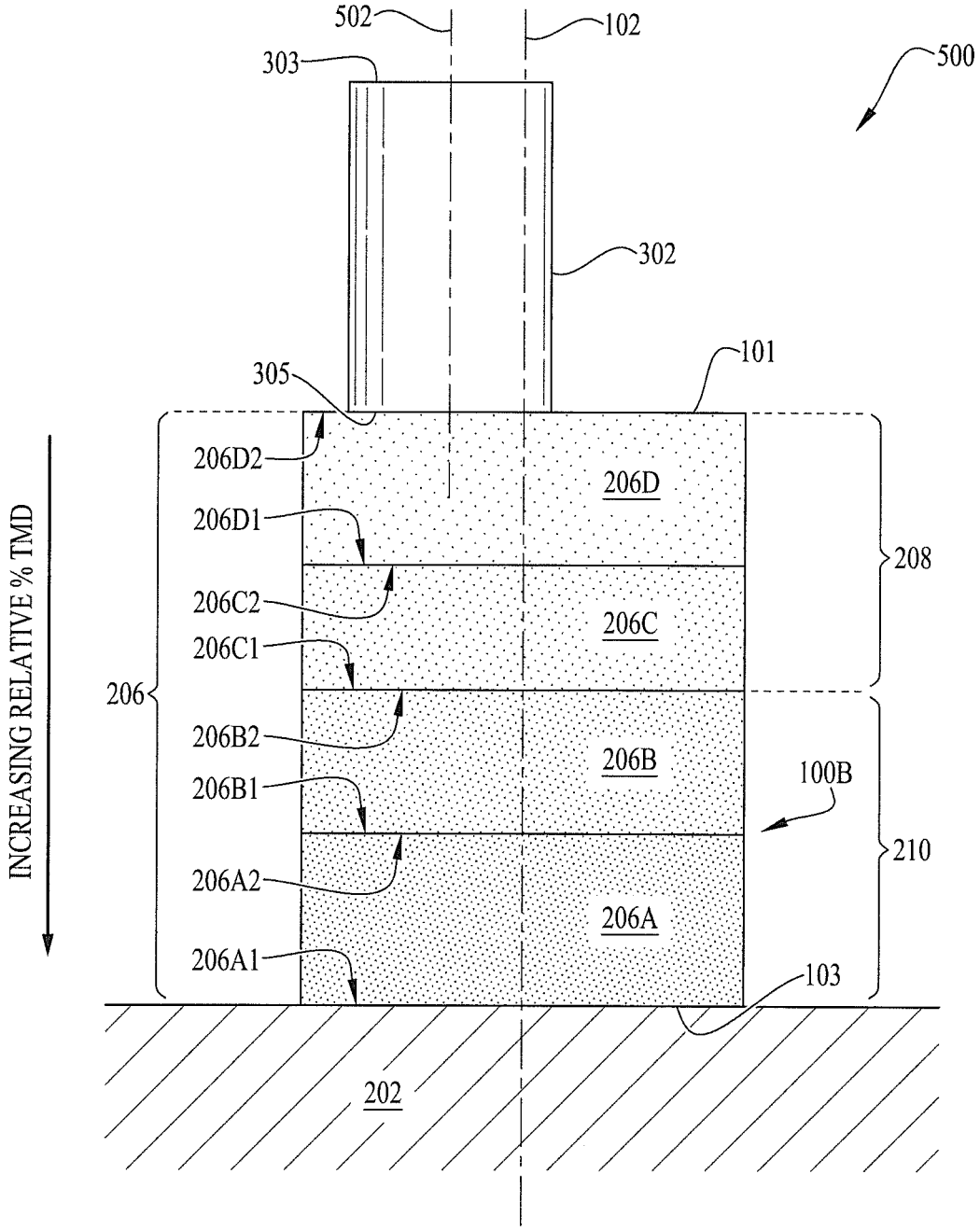
FIGS. 5 and 6 illustrate additional variations of the insensitive cylindrically-shaped acceptor explosive pellet in other firing train embodiments.

FIG. 5 illustrates an additional firing train embodiment and is depicted with reference character 500. The FIG. 5 embodiment 500 is similar to the FIG. 3 embodiment 300, except that the donor explosive pellet central longitudinal axis is visible and is depicted by reference character 502. In FIG. 5, it is evident that the donor explosive pellet 302 and the insensitive cylindrically-shaped acceptor explosive pellet 100B are not aligned, i.e. are offset from each other, because the donor explosive pellet central longitudinal axis 502 and the central longitudinal axis 102 of the insensitive cylindrically-shaped acceptor explosive pellet 100B are not aligned with each other and lie in different axes.

The donor explosive pellet 302 is configured to be initiated in any of the manners identified above. The initiation causes the donor explosive pellet 302 to provide a shock stimulus to the insensitive cylindrically-shaped acceptor explosive pellet 100B. The shock stimulus then initiates a shock-to-detonation transfer reaction within the insensitive cylindrically-shaped acceptor pellet 100B. The shock-to-detonation transfer reaction in the cylindrically-shaped acceptor pellet 100B drives a detonation wave into the insensitive explosive fill 202, causing the insensitive explosive fill to detonate.

Figure 6:
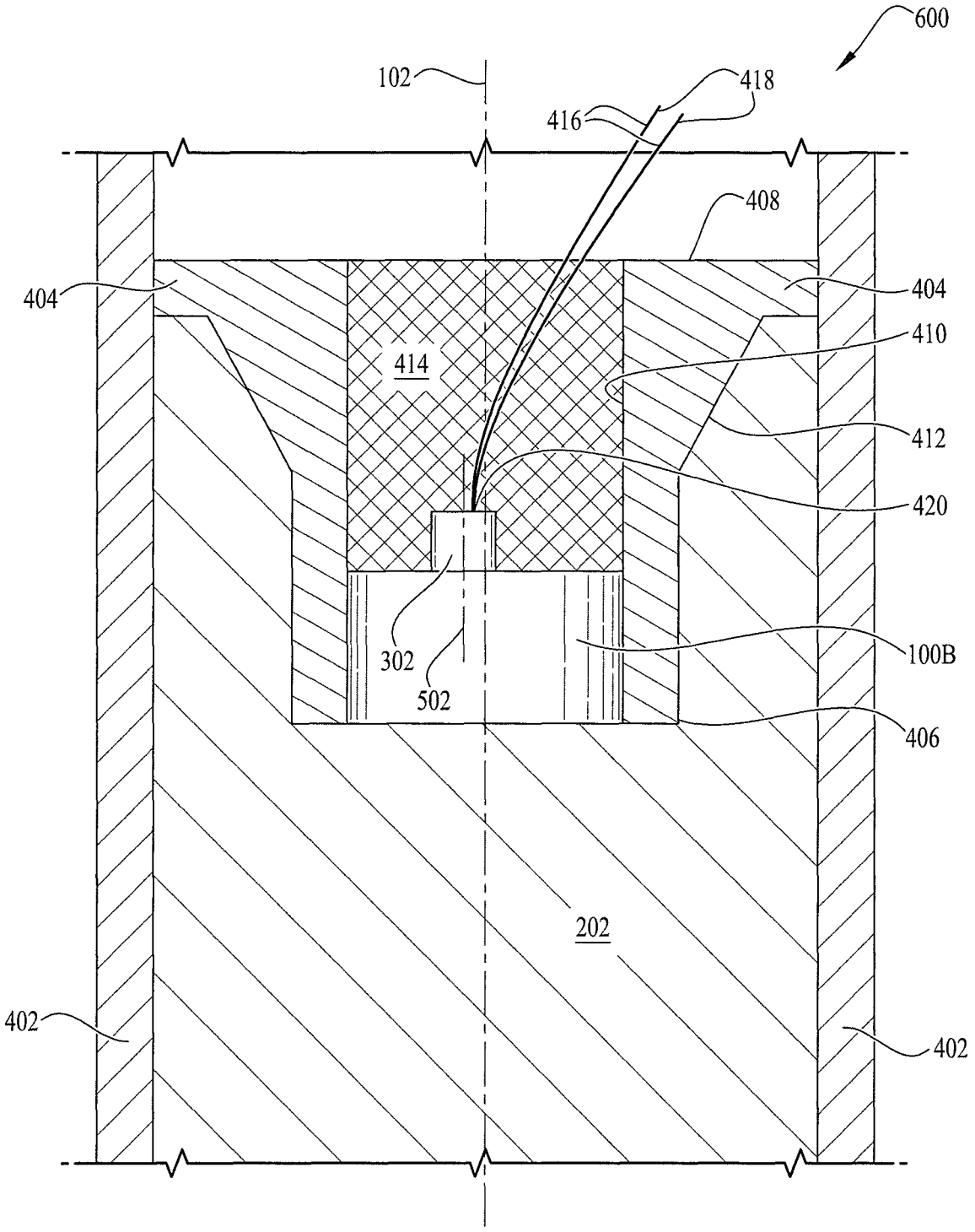

FIG. 6 also illustrates yet another variation of how the insensitive cylindrically-shaped acceptor explosive pellet 100B relates to another operating environment 600 of a firing train in the aft end of a generic munition. The FIG. 6 operating environment 600 is a separate embodiment that builds on what was presented in the FIG. 5 embodiment and is also a variation of the FIG. 4 environment 400.

Referring to FIGS. 4 and 6, a person having ordinary skill in the art will recognize that the munition has a munition case 402. The munition case 402 is concentric about a hollow fuze well 404. The hollow fuze well 404 is sometimes simply referred to as a fuze well. The fuze well 404 has a proximal end 406, a distal end 408, an inner surface 410, and an outer surface 412. In the embodiment depicted, fuze well 404 is open on both the proximal 406 and distal 408 ends.

The fuze well 404 houses a munition fuze 414. The munition fuze 414 is sometimes referred to as a fuze body or more simply as a fuze and is generically shown for ease of viewing. The munition case 402 houses an insensitive explosive fill 202. A person having ordinary skill in the art will recognize that liners can be used in munitions such as, for example, having a liner between the insensitive explosive fill 202 and the munition case 402. As such, liners are not depicted in the figures.

The fuze well 404 is shown in somewhat exaggerated form with the understanding that a person having ordinary skill in the art will recognize that additional attachment components or structural features are not shown in FIGS. 4 and 6 for ease of viewing. Components not shown, but understood to be included, include components and/or features to assist with attaching, for example, the fuze well 404, inside the munition case 402 as the fuze well is torqued into the munition's aft end. Additional components are also understood by a person having ordinary skill in the art to be used for securing the fuze 414 inside the fuze well 404. Additionally, it is understood that closure components at the munition's aft end are used for sealing the aft end to the environment. Some examples of the components and/or structural features include, but are not limited to, rings, plates, seals, screws, and brackets.

As shown in FIGS. 4 and 6, the insensitive cylindrically-shaped acceptor explosive pellet 100B is positioned and housed inside of the fuze well 404 at the proximal end 406 of the fuze well. The proximal end 101 of the insensitive cylindrically-shaped acceptor explosive pellet 100B is in adjacent contact with the fuze 414. The contact can be intimate adjacent contact or proximal adjacent contact. Additionally, since the fuze well 404 is open at its proximal end 406, the distal end 103 of the insensitive cylindrically-shaped acceptor explosive pellet 100B is in adjacent contact, either proximal or intimate adjacent contact, with the insensitive explosive fill 202.

The donor explosive pellet 302 is also inside the hollow fuze well 404 and, as shown in FIGS. 4 and 6, inside the fuze body 414. The second end 305 of the donor explosive pellet 302 is in adjacent contact, either intimate adjacent contact or proximal adjacent contact, with the proximal end 101 of the insensitive cylindrically-shaped acceptor explosive pellet 100B. In FIG. 4, the donor explosive pellet axis 502 is not visible because the donor explosive pellet 302 and the insensitive cylindrically-shaped acceptor explosive pellet 100B are centered on the same axis, i.e. aligned along the same axis. Hence only the central longitudinal axis 102 of the insensitive cylindrically-shaped acceptor explosive pellet 100B is visible. However, in FIG. 6, the donor explosive pellet 302 and the insensitive cylindrically-shaped acceptor explosive pellet 100B are not aligned, i.e. they are not centered and are offset from one another. Hence, both the central longitudinal axis 102 of the insensitive cylindrically-shaped acceptor explosive pellet 100B and the donor explosive pellet central longitudinal axis 502 for the donor explosive pellet 302 are clearly visible, illustrating that they are not aligned with each other and lie in different axes.

In both FIGS. 4 and 6, explosive leads or detonators are well-known in the art. Reference character 416 is used to depict a detonator, sometimes referred to as at least one detonator. The detonator lead 416 is generically shown with a first end 418 and a second end 420 and is inside the fuze 414. The detonator 416 receives initiation instruction signals. A person having ordinary skill in the art will understand the sources of the initiation instruction signals and communication paths, hence that information is not depicted or explained in detail. The second end 420 of the detonator 416 terminates at the first end 303 of the donor explosive pellet 302.

Generally Applicable to All Embodiments

The density gradient booster pellet 100A/100B is constructed of at least four zones or regions, which is referred to as a plurality of density zones 206, or a plurality of density regions, or similar terminology from the proximal end 101 to the distal end 103. The term "a four-layer stack" or "at least a four-layer stack" is also applicable. As constructed, in FIG. 2, the plurality of density zones 206 are applied or pressed from the distal end 103 to the proximal end 101, either by pressing or additive manufacturing techniques. As such, nomenclature for the plurality of density zones 206 are referred to in the order that they are applied or constructed from distal end 103 to the proximal end 101 or, stated another way, from the greatest density at the distal end 103 to the least density at the proximal end 101.

The plurality of density zones 206 shown in FIG. 2 include a first density zone 206A, a second density zone 206B, a third density zone 206C, and a fourth density zone 206D. A person having ordinary skill in the art will recognize that the density gradient booster pellet 100A/100B can be constructed of greater than four zones depending on application-specific conditions.

The density gradient booster pellet 100A/100B has a density gradient region 208 defined from the proximal end 101 to half-way between the proximal end and the distal end 103 of the insensitive cylindrically-shaped pellet. Referring to FIGS. 2 and 3, it is evident that the density gradient region 208 is the third density zone 206C and the fourth density zone 206D of the density gradient booster pellet 100A/100B.

Therefore, the density gradient booster pellet 100A/100B is a plurality of density zones 206 transitioning from a minimum density at the proximal end 101 to a maximum density at the distal end 103. Moreover, the density gradient booster pellet 100A/100B is configured to accommodate an increasing relative percent theoretical maximum density, often referred to as relative percent theoretical maximum density (TMD), relative TMD, and similar variations from the proximal end 101 to the distal end 103.

The term "relative theoretical maximum density (TMD)" is understood to be the theoretical maximum density, expressed as a percentage, of an explosive molecule, i.e. the mass per unit volume of a single crystal of the explosive. Explosive formulations consist of thousands of these molecules in a matrix (binder) of some sort to keep it all together physically. Once multiple crystals are pressed together in a binder to make a pellet, the density of the pellet will always be lower than this maximum. The goal is to get as close as possible to the maximum.

Based on this understanding, the plurality of density zones 206 is a plurality of relative percent TMD zones having a first relative percent TMD zone 206A, a second relative percent TMD zone 206B, a third relative percent TMD zone 206C, and a fourth relative percent TMD zone 206D. The plurality of relative percent TMD zones 206 are substantially-flat layers. The word "percent" can be dropped in the description, thus resulting in a plurality of relative TMD zones 206 having first, second, third, and fourth relative TMD zones 206A, 206B, 206C, and 206D.

The first relative percent TMD zone 206A has a first side 206A1 and a second side 206A2. The first side 206A1 of the first relative percent TMD zone 206A is in intimate adjacent contact with the insensitive explosive fill 202. The first relative percent TMD zone 206A has a relative percent TMD of about 97 percent its first side 206A1 and a relative percent TMD of about 96 percent at its second side 206A2.

The second relative percent TMD zone 206B has a first side 206B1 and a second side 206B2. The first side 206B1 of the second TMD zone 206B is in intimate adjacent contact with the second side 206A2 of the first relative percent TMD zone 206A. The second relative percent TMD zone 206B has a relative percent TMD of about 96 percent its first side 206B1 and a relative percent TMD of about 95 percent at its second side 206B2.

The third relative percent TMD zone 206C has a first side 206C1 and a second side 206C2. The first side 206C1 of the third TMD zone 206C is in intimate adjacent contact with the second side 206B2 of the second relative percent TMD zone 206B. The third relative percent TMD zone 206C has a relative percent TMD of about 95 percent its first side 206C1 and a relative percent TMD of about 88 percent at its second side 206C2.

The fourth relative percent TMD zone 206D has a first side 206D1 and a second side 206D2. The first side 206D1 of the fourth TMD zone 206D is in intimate adjacent contact with the second side 206C2 of the third relative percent TMD zone 206C. The fourth relative percent TMD zone 206D has a relative percent TMD of about 88 percent its first side 206D1 and a relative percent TMD of about 81 percent at its second side 206D2. Based on this, it is evident that the density gradient booster pellet 100A/100B has a maximum relative percent TMD of about 97 percent at the distal end 103 (the output end/surface) and a minimum relative percent TMD of about 81 percent at the proximal end 101 (the input end/surface).

The density gradient booster pellet 100A/100B is about one inch in height and about one inch in diameter. Each of the first, second, third, and fourth relative percent TMD zones 206A, 206B, 206C, and 206D have a thickness measured parallel to the central longitudinal axis 102 of about one-quarter inch. Additionally, the proximal and distal ends 101 and 103 of the density gradient booster pellet 100A/100B are substantially-flat surfaces.

Theory of Operation

Figure 7:
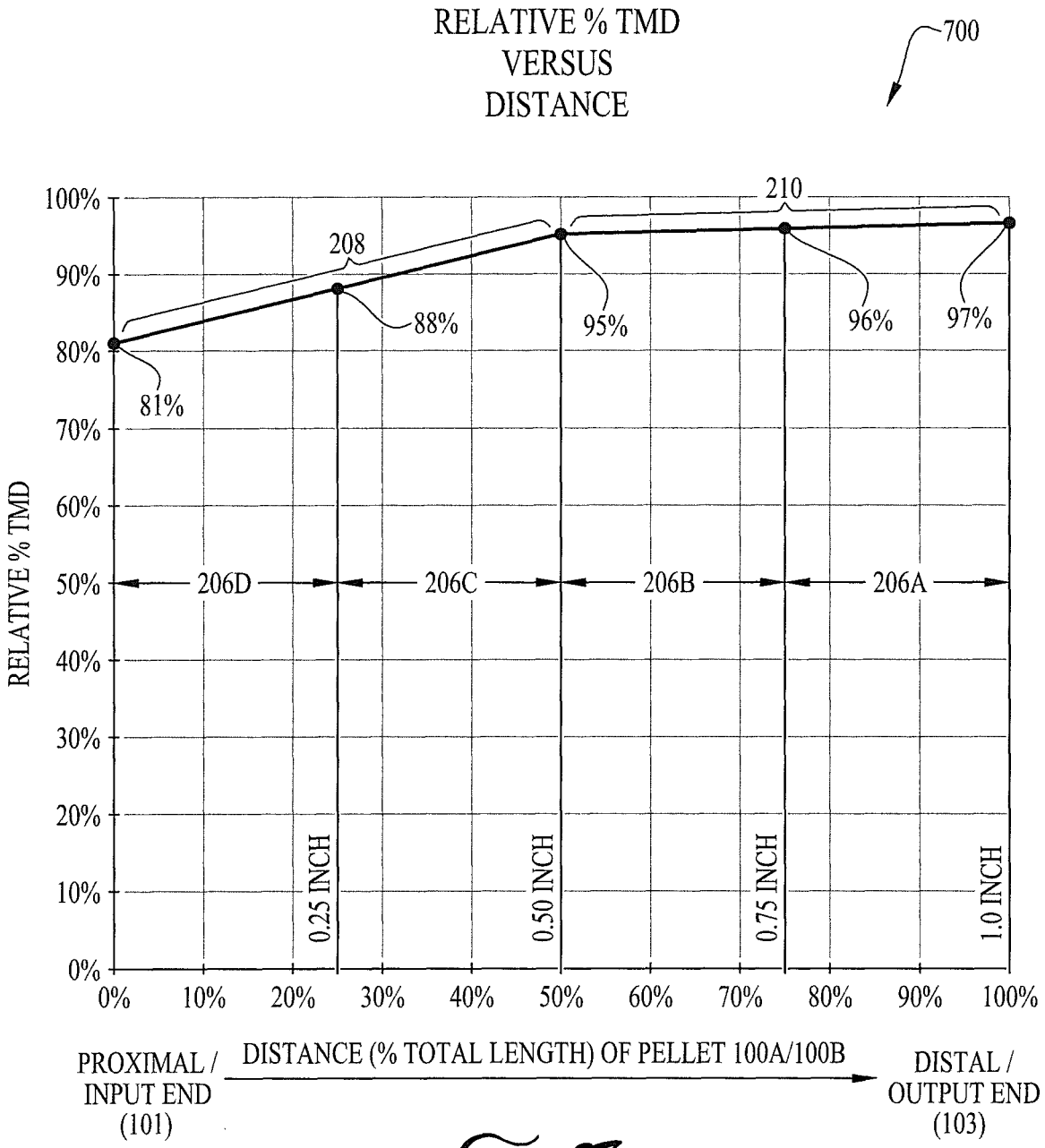
FIG. 7 depicts a graphical representation of the distance of the density gradient booster pellet from the proximal end to the distal end versus corresponding relative percent theoretical maximum density, according to the embodiments.

For purposes of describing the theory, especially as it relates to FIG. 7, the "density gradient booster pellet" 100A/100B is used for simplicity here to include both the "insensitive cylindrically-shaped explosive pellet" 100A and the "insensitive cylindrically-shaped acceptor explosive pellet" 100B. In other instances, especially related to the firing train embodiments disclosed in FIGS. 3 through 6, the theory is explained in reference to the associated insensitive cylindrically-shaped acceptor explosive pellet 100B are used to explain the theory.

Density and, in particular, the density gradient region 208, i.e. linearly increasing density, is incorporated into the density gradient booster pellet 100A/100B and controlled by means of a multiple pressing operation utilizing unique stepped presses with varying degrees of loading pressure. Alternatively, the density can be extremely tightly controlled using additive manufacturing energetic processes.

Understanding the effects shock stimulus has on the density gradient booster pellet 100A/100B is best explained in accord with the firing train embodiments. Upon initiation, a detonation wave is produced and driven longitudinally from the proximal end 101 through the plurality of relative percent TMD zones 206 and to the distal end 103 of the insensitive cylindrically-shaped acceptor explosive pellet 100B. The plurality of relative percent TMD zones 206 provide localized high regions of heat and shock iterations at void locations, sometimes referred to as micro-voids, in the density gradient booster pellet 100A/100B. The micro-voids are not shown in the figures for ease of viewing.

In the disclosed firing train embodiments, when the shock stimulus is transferred from the donor explosive pellet 302 to the insensitive cylindrically-shaped acceptor explosive pellet 100B, the micro-voids collapse. This concept is best understood by considering a dish washing sponge and its voids. When a user places the dish washing sponge in his or her hand and clinches the hand, the voids collapse quickly. With respect to the insensitive cylindrically-shaped acceptor explosive pellet 100B, the micro-voids are on a much smaller scale than the dish washing sponge. As the micro-voids in the insensitive cylindrically-shaped acceptor explosive pellet 100B are collapsed as a result of the imposed shock stimulus from the donor explosive pellet 302 and the resulting detonation wave traveling through the insensitive cylindrically-shaped acceptor explosive pellet, the micro-voids get hot. These hot spots, referred to as localized regions of heat, add to the detonation wave, increasing shock-to-detonation transition rates, sometimes simply referred to as shock-to-detonation rates.

The embodiments, therefore, exploit this behavior by imposing the disclosed relative percent TMD zones 206 into the insensitive cylindrically-shaped acceptor explosive pellet 100B, thereby tailoring the profile and layout of the localized hot spots, i.e. localized high regions of heat. The localized high regions of heat and shock iterations, therefore, increase shock-to-detonation rates, which increases the detonation wave strength impacting the insensitive explosive fill 202, causing the insensitive explosive fill to more promptly transition to detonation. Stated another way, the insensitive explosive fill 202 initiates promptly via a shock-to-detonation transition event as a result of the stimulus provided by the distal end 103 (full density, i.e. high output) of the insensitive cylindrically-shaped acceptor explosive pellet 100B.

These techniques allow the density to transition through a gradient (the density gradient region 208) within the insensitive cylindrically-shaped acceptor explosive pellet 100B to allow the explosive output of the insensitive cylindrically-shaped acceptor explosive pellet to not be sacrificed. Additionally, this provides a smooth transition to constant/full or nearly constant/full density from the midpoint to the distal end (output surface) 103 of the insensitive cylindrically-shaped acceptor explosive pellet 100B. The smooth transition prevents an abrupt density change, which could cause an unwanted inducement of a reflection or rarefaction wave within the insensitive cylindrically-shaped acceptor explosive pellet 100B.

FIG. 7 depicts a graphical representation (reference character 500) of the underlying theory of the embodiments in an x-y graph. The graph depicts distance of the density gradient booster pellet 100A/100B (the insensitive cylindrically-shaped explosive pellet/insensitive cylindrically-shaped acceptor explosive pellet) (on the x-axis) versus relative percent TMD (on the y-axis). Due to the density gradient booster pellet 100A/100B having a height of one inch, the x-axis, shown in distance percentages, can also be considered as tenths of an inch. Thus, the fifty percent mark is one-half inch and, similarly, the seventy-five percent mark is three-quarters of an inch.

The origin on the x-y graph 700 on the x-axis represents the proximal end 101 (labeled as "input end") of the density gradient booster pellet 100A/100B. The distance increases to the right of the graph 500 along the x-axis until reaching the distal end 103 (labeled as "output end") of the density gradient booster pellet 100A/100B. The relative percent TMD is linearly increasing from the origin to the midpoint, corresponding to the density gradient region 208 and the third and fourth relative percent TMD zones 206C and 206D. The relative percent TMD is nearly constant from the midpoint to the distal end 103, corresponding to the first and second relative percent TMD zones 206A and 206B. Thus, the first and second TMD zones 206A and 206B can be referred to as a constant density region 210 or a nearly constant density region, or a substantially-constant density region, or finally as a full or maximum density region.

As shown in FIG. 7, the relative percent TMD percent is about 81 percent at the origin, corresponding to the proximal/input end 101. The relative percent TMD percent range in the fourth relative percent TMD zone 206D, which corresponds to a low or minimum density zone, is about 81 percent to about 88 percent. The relative percent TMD percent range in the third relative percent TMD zone 206C, corresponds to a transition or a transition density zone, is about 88 percent to about 95 percent. The relative percent TMD percent range in the second relative percent TMD zone 206B, corresponds to a nearly full or constant density zone, is about 95 percent to 96 percent. Similarly, the relative percent TMD percent range in the first relative percent TMD zone 206A, corresponds to a constant/full density, is about 96 percent to about 97 percent. Based on this, one concludes that the relative percent TMD percent of the density gradient booster pellet 100A/100B ranges from about 81 percent (a minimum value) at the proximal/input end 101 to about 97 percent (a maximum value) at the distal/output end 103.

While the embodiments have been described, disclosed, illustrated and shown in various terms of certain embodiments or modifications which it has presumed in practice, the scope is not intended to be, nor should it be deemed to be, limited thereby and such other modifications or embodiments as may be suggested by the teachings herein are particularly reserved especially as they fall within the breadth and scope of the claims here appended.

What is claimed is:

1. A firing train, comprising:

an insensitive cylindrically-shaped acceptor explosive pellet having a proximal end, a distal end, and a central longitudinal axis spanning from said proximal end to said distal end;

wherein said insensitive cylindrically-shaped acceptor explosive pellet having a plurality of relative percent theoretical maximum density (TMD) zones from said proximal end to said distal end;

wherein sensitivity of said insensitive cylindrically-shaped acceptor explosive pellet decreases from said proximal end to said distal end, wherein explosive output of said insensitive cylindrically-shaped acceptor explosive pellet increases from said proximal end to said distal end;

wherein said plurality of relative percent TMD zones having an increasing relative percent TMD from said proximal end to said distal end;

a donor explosive pellet having a donor explosive pellet central longitudinal axis, said donor explosive pellet positioned in intimate adjacent contact with said proximal end of said insensitive cylindrically-shaped acceptor explosive pellet;

wherein said distal end of said insensitive cylindrically-shaped acceptor explosive pellet is in adjacent contact with an insensitive explosive and wherein said donor explosive pellet is configured to initiate, said initiation causing said donor explosive pellet to provide a shock stimulus to said insensitive cylindrically-shaped acceptor explosive pellet and initiate said insensitive cylindrically-shaped acceptor explosive pellet.

2. The firing train according to claim 1, further comprising:

wherein said plurality of relative percent TMD zones transitioning from a minimum relative percent TMD at said proximal end to a maximum relative percent TMD at said distal end;

wherein said plurality of relative percent TMD zones, comprising:

first, second, third, and fourth relative percent TMD zones;

said first relative percent TMD zone having a first side and a second side, said first side of said first relative percent TMD zone in intimate adjacent contact with said insensitive explosive fill;

said second relative percent TMD zone having a first side and a second side, said first side of said second relative percent TMD zone in intimate adjacent contact with said second side of said first relative percent TMD zone;

said third relative percent TMD zone having a first side and a second side, said first side of the third relative percent TMD zone in intimate adjacent contact with said second side of said second relative percent TMD zone; and said fourth relative percent TMD zone having a first side and a second side, said first side of said fourth relative percent TMD zone in intimate adjacent contact with said third side of said second relative percent TMD zone.

3. The firing train according to claim 2, further comprising:

a density gradient region defined by said third and fourth relative percent TMD said density gradient region having a linearly increasing relative percent TMD from said proximal end and through said third and fourth relative percent TMD zones; and a full density region defined by said first and second relative percent TMD zones, said full density region having a substantially constant relative percent TMD of 95 to 97 percent.

4. The firing train according to claim 1, wherein said central longitudinal axis of said insensitive cylindrically-shaped acceptor explosive pellet and said donor explosive pellet central longitudinal axis are aligned.

5. The firing train according to claim 2, wherein each of said first, second, third, and fourth relative percent TMD zones having an equal thickness measured parallel to said central longitudinal axis.

6. The firing train according to claim 3, wherein said linearly increasing relative percent TMD is a linear range of 81 percent to 95 percent.

7. The firing train according to claim 1, wherein said proximal and said distal ends are substantially-flat surfaces.

8. The firing train according to claim 1, wherein said shock stimulus and said initiation of said insensitive cylindrically-shaped acceptor explosive pellet causes detonation wave to be driven longitudinally from said proximal end through said plurality of relative percent TMD zones and to said distal end, and into said insensitive explosive fill.

9. A firing train in the aft end of a munition, comprising:
a munition having an aft end and a munition case;
an insensitive explosive fill housed in said munition case;
a hollow fuze well attached to said aft end, said munition case concentric about said hollow fuze well, said hollow fuze well housing a munition fuze;
a donor explosive pellet inside said hollow fuze well, said donor explosive pellet having a first end, a second end, and a donor explosive pellet central longitudinal axis;
an insensitive cylindrically-shaped acceptor explosive pellet housed inside said hollow fuze well, said insensitive cylindrically-shaped acceptor explosive pellet having a proximal end, a distal end, and a central longitudinal axis spanning from said proximal end to said distal end, wherein distal end is in adjacent contact with said insensitive explosive fill;
wherein said donor explosive pellet is positioned in intimate adjacent contact with said proximal end of said insensitive cylindrically-shaped acceptor explosive pellet; and
wherein said donor explosive pellet is configured to initiate, said initiation causing said donor explosive pellet to provide a shock stimulus to said insensitive cylindrically-shaped acceptor pellet and initiate said insensitive cylindrically-shaped acceptor pellet.

10. The firing train according to claim 9, said firing train, further comprising:
a plurality of relative percent theoretical maximum density (TMD) zones from said proximal end to said distal end of said insensitive cylindrically-shaped acceptor explosive pellet;
wherein sensitivity of said insensitive cylindrically-shaped acceptor explosive pellet decreases through said plurality of relative percent TMD zones, from said proximal end to said distal end, wherein explosive output of said insensitive cylindrically-shaped acceptor explosive pellet increases from said proximal end to said distal end; and
wherein said plurality of relative percent TMD zones having an increasing relative percent TMD from said proximal end to said distal end.

11. The firing train according to claim 10, said plurality of relative percent TMD zones transitioning from a minimum relative percent TMD at said proximal end to a maximum relative percent TMD at said distal end.

12. The firing train according to claim 10, said plurality of relative percent TMD zones, comprising:
first, second, third, and fourth relative percent TMD zones;
said first relative percent TMD zone having a first side and a second side; said first side of said first relative percent TMD zone in intimate adjacent contact with said insensitive explosive fill;
said second relative percent TMD zone having a first side and a second side, said first side of said second relative percent TMD zone in intimate adjacent contact with said second side of said first relative percent TMD zone;
said third relative percent TMD zone having a first side and a second side, said first side of the third relative percent TMD zone in intimate adjacent contact with said second side of said second relative percent TMD zone; and
said fourth relative percent TMD zone having a first side and a second side, said first side of said fourth relative percent TMD zone in intimate adjacent contact with said second side of said third relative percent TMD zone.

13. The firing train according to claim 12, further comprising:
a density gradient region defined by said third and fourth relative percent TMD zones, said density gradient region having a linearly increasing relative percent TMD from said proximal end and through said third and fourth relative percent TMD zones; and
a full density region defined by said first and second relative percent TMD zones, said full density region having a substantially constant relative percent TMD of 95 to 97 percent.

14. The firing train according to claim 13, wherein said linearly increasing relative percent TMD is a linear range of 81 percent to 95 percent.

15. The firing train according to claim 11, wherein said minimum relative percept TMD is 81 percent at said proximal end; Wherein said maximum relative percent TMD is 97 percent at said distal end.

16. The firing train according to claim 9, wherein said shock stimulus and said initiation of said insensitive cylindrically-shaped acceptor explosive pellet causes a detonation wave to be driven longitudinally from said proximal end through said plurality of relative percent TMD zones and to said distal end, and into said insensitive explosive fill.

17. The firing train according to claim 9, wherein said central longitudinal axis of said insensitive cylindrically-shaped acceptor explosive pellet and said donor explosive pellet central longitudinal axis are aligned.

18. The firing train according to claim 12, wherein each of said first, second, third, and fourth relative percent TMD zones having an equal thickness measured parallel to said central longitudinal axis.

19. The firing train according to claim 9, wherein said proximal and said distal ends are substantially-flat surfaces.

* * * * *